US008517696B2

(12) United States Patent
McLoughlin et al.

(10) Patent No.: US 8,517,696 B2
(45) Date of Patent: Aug. 27, 2013

(54) COMPREHENSIVE CONTROL SYSTEM FOR MOBILE PUMPING APPARATUS

(76) Inventors: John E. McLoughlin, Hauppage, NY (US); Neocles G. Athanasiades, Setauket, NY (US); Kiam Meng Toh, Hauppage, NY (US)

( * ) Notice: Subject to any disclaimer, the term of this patent is extended or adjusted under 35 U.S.C. 154(b) by 497 days.

(21) Appl. No.: 12/560,398

(22) Filed: Sep. 15, 2009

(65) Prior Publication Data

US 2011/0064591 A1 Mar. 17, 2011

(51) Int. Cl.
*F04B 49/00* (2006.01)

(52) U.S. Cl.
USPC ..... 417/282; 417/300

(58) Field of Classification Search
USPC ..... 417/26, 29, 36, 199.1, 201, 202, 417/282, 300; 169/24, 5, 13, 14, 16, 19, 169/20, 56, 60, 61; 239/329, 331, 332, 334, 239/569, 570, 574; 137/565.29, 597
See application file for complete search history.

(56) References Cited

U.S. PATENT DOCUMENTS

| | | | | |
|---|---|---|---|---|
| 4,189,005 | A * | 2/1980 | McLoughlin | 169/24 |
| 4,246,969 | A | 1/1981 | McLoughlin et al. | |
| 4,324,294 | A * | 4/1982 | McLoughlin et al. | 169/13 |
| 4,345,654 | A * | 8/1982 | Carr | 169/24 |
| 5,249,631 | A * | 10/1993 | Ferren | 169/52 |
| 5,797,421 | A * | 8/1998 | Merrett | 137/236.1 |
| 5,888,051 | A | 3/1999 | McLoughlin et al. | |
| 6,444,088 | B2 * | 9/2002 | Rokman et al. | 162/101 |
| 7,040,868 | B2 | 5/2006 | McLaughlin et al. | |
| 7,055,546 | B2 | 6/2006 | McLaughlin et al. | |
| 7,156,133 | B2 | 1/2007 | McLaughlin et al. | |
| 7,987,916 | B2 * | 8/2011 | Laskaris et al. | 169/24 |
| 2005/0047921 | A1 | 3/2005 | McLaughlin et al. | |
| 2005/0061373 | A1 * | 3/2005 | McLaughlin et al. | 137/565.13 |
| 2006/0011260 | A1 | 1/2006 | McLaughlin et al. | |
| 2007/0175513 | A1 * | 8/2007 | McLoughlin et al. | 137/87.02 |
| 2008/0292472 | A1 * | 11/2008 | Laskaris | 417/34 |

* cited by examiner

*Primary Examiner* — Peter J Bertheaud
*Assistant Examiner* — Dnyanesh Kasture
(74) *Attorney, Agent, or Firm* — Wei Wei Jeang; Andrews Kurth LLP

(57) ABSTRACT

A control system for a pumping apparatus consisting of an engine-driven primary pump includes an intake pressure regulating system for maintaining the intake pressure above a preset low value, a discharge pressure regulating system for maintaining the discharge pressure below a preset maximum value, and a master controller for monitoring, recording, and controlling the intake and discharge pressure regulating systems and other components of the system. The discharge pressure regulating system includes a pump governor which varies the engine RPM and operates a relief valve in response to fluctuations in discharge pressure. The intake pressure regulating system includes a reserve tank that is automatically maintained at a preset level which determines the minimum intake pressure of the system. The system may also include a priming pump, foam tanks, foam pumps, bottled nonflammable gas, and an air compressor.

2 Claims, 4 Drawing Sheets

COMPREHENSIVE CONTROL SYSTEM FOR MOBILE PUMPING APPARATUS

BACKGROUND

1. Field of the Invention

This invention relates to the art of pump control systems.

More particularly, the invention relates to a system for controlling and monitoring all the functions of a mobile fire pump apparatus having an electronically-controlled engine.

In a further and more specific aspect, the instant invention concerns a comprehensive electronic system for controlling the flow of fluids through an engine-driven fire pump.

2. Description of the Prior Art

Over the years, various systems have been devised for controlling engine-driven fire pumps. For instance, U.S. Pat. Nos. 3,786,689 and 4,189,005 to McLoughlin, as well as U.S. Pat. No. 5,888,052 to McLoughlin et al., disclose apparatus for controlling the pressure output from engine-driven centrifugal fire pumps. Likewise, U.S. Patent Application Publication No. 2005/0061373 to McLaughlin et al. discloses a system for regulating the fluid intake pressure of a pumping system, while U.S. Pat. No. 7,040,868 and U.S. Patent Publication No. 2005/7,040,868, both to McLoughlin et al., disclose systems for controlling pumping speed during discharge pressure fluctuations. Each of the aforementioned systems is somewhat limited in that it is designed primarily for the control of a single parameter (i.e. discharge pressure, intake pressure, or pump speed). None is a comprehensive system for simultaneously monitoring all the aspects of both fluid flow and engine performance. Furthermore, each of these systems is designed to control the flow of a single fluid (typically water) and does not include means for controlling the flow of any supplementary fluids, such as firefighting foam, which may be added to the discharge.

Accordingly, there exists a need for a comprehensive control system for simultaneously monitoring and controlling all the functions of an engine-driven mobile pumping apparatus.

SUMMARY OF THE INVENTION

Briefly, to achieve the desired objects of the instant invention in accordance with the preferred embodiments thereof, a system is provided for simultaneously monitoring and controlling all the functions of an engine-driven mobile pumping apparatus. Specifically, the system includes an engine-driven primary pump, an intake system for delivering liquid to the pump, and a discharge system for dispensing liquid from the pump. The intake system includes a supply line that is coupleable to both a reserve tank and a pressurized source, as well as an intake pressure sensor for monitoring the pressure upstream of the pump and an intake pressure regulating system for maintaining the intake pressure above a preset low inlet pressure $P_{LOW}$. The discharge system includes at least one hose terminating in a discharge nozzle, a discharge pressure sensor for monitoring the pressure downstream of the pump, and a discharge pressure regulating system for maintaining the discharge pressure below a preset maximum discharge pressure $P_{MAX}$ The intake and discharge regulating systems are controlled by a master processor that also monitors and records various other conditions of the system such engine speed, voltage, current, temperature, and sends information about these conditions to the vehicle's control display and/or warning systems.

In a preferred embodiment of the invention, the intake system includes a first conduit coupleable to the pressurized source, a second conduit coupleable to an inlet opening in the reserve tank, and a third conduit coupleable to an outlet opening in the reserve tank. The intake pressure regulating system includes control valves in the first, second, and third conduits.

The discharge system in this embodiment includes a discharge valve in the at least one discharge hose, and a pressure relief valve upstream of the primary pump.

The system is programmed such that at start up, only the valve in the third conduit is open, so that the initial intake pressure is proportional to the level of water in the reserve tank. If the discharge pressure is lower than a preset minimum level $P_{MIN}$, a priming pump is actuated until $P_{MIN}$ is reached. When $P_{MIN}$ is reached, the priming pump switches off, but the valve in the third conduit remains open, and the other two valves stay shut until the discharge pressure sensor detects that that a preset desired output pressure $P_D$ (typically somewhere between 100 and 150 psi) has been reached. At this point, if there is a pressurized source available, the valve in the third conduit is closed, and the valve in the first conduit is opened, so that water for the pump is supplied from the pressurized tank rather than from the reserve tank. Also, if the liquid level in the tank is below a preset minimum, the valve in the second conduit opens, allowing a portion of the liquid in the pressurized source to be diverted into the tank. As soon as the liquid level rises to its desired level, the valve in the second conduit closes again.

From this point onward, the system is maintained at more or less steady state by the engine governor, which responds to changes in discharge pressure by varying the RPM of the engine and/or actuating the relief valve, as needed. If the intake pressure suddenly drops below a preset low value $P_{LOW}$, the valve in the third conduit reopens, allowing liquid from the tank to enter the system at a pressure proportional to the water level. When the intake pressure goes back over $P_{LOW}$, this valve closes and the valve in the first conduit second conduit reopens, allowing the tank to be refilled.

Other components of the system include foam pumps for dispensing various firefighting foams, an air compressor for delivering rescue air to the firefighters, and a tank of compressed nitrogen or other non-flammable gases. Operation of all of these components is controlled by the master processor.

BRIEF DESCRIPTION OF THE DRAWINGS

The foregoing and further and more specific objects and inventions of the instant invention will become readily apparent to those skilled in the art from the following detailed description of a preferred embodiment thereof taken in conjunction with the drawings, in which.

DETAILED DESCRIPTION OF THE PREFERRED EMBODIMENT

Figure 1:
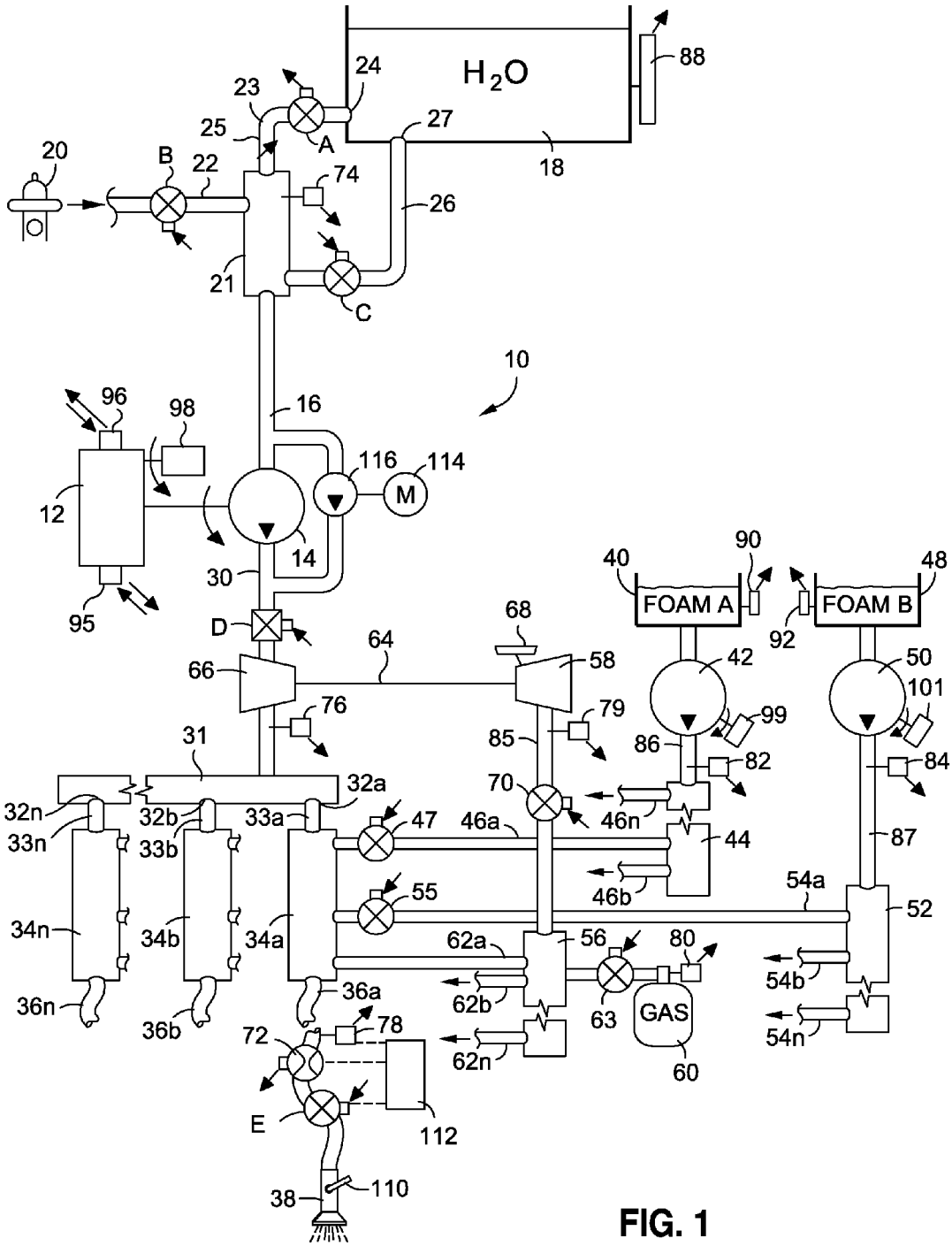
FIG. 1 is a schematic drawing of a control system according to the present invention.

Turning to the drawings in which like reference characters indicate corresponding elements throughout the several views, attention is first directed to FIG. 1, which shows a schematic diagram of the control system 10 for a mobile pumping apparatus such as a fire truck (not shown). A gasoline or diesel engine 12 is mechanically coupled to a main centrifugal pump 14 having a supply line 16 which is coupleable to multiple fluid sources such as, for instance, a truck-mounted water tank 18 and a fire hydrant 20. Various arrangements may be used for coupling the supply line 16 to the water tank 18 and the hydrant 20, but in the illustrated embodiment, the terminal end of the supply line 16 is connected to an inlet manifold 21 that connects to a first hose 22 leading to the hydrant 20 and a second hose 23 leading to an inlet opening 24 in the water tank 18. The second hose 23 includes a one-way check valve 25 preventing water from the tank 18 from flowing out towards the hydrant 20. In addition, a third hose 26 leads from an outlet opening 27 in the tank 18 to the inlet manifold 21.

The discharge line 30 of the pump 14 is coupled to a discharge manifold 31 having a plurality of openings 32*a, b* . . . n, each of which may accommodate a fluid conduit 33*a, b* . . . n that is coupled to a mixing manifold 34*a, b* . . . n which allows water from the discharge line 30 to mix with additives such as foams, compressed gas, and air from various sources before finally being discharged through a fire hose 36*a, b*, . . . n terminating in a nozzle 38.

More specifically, the additives may include a Class A foam concentrate suitable for fighting wildfires and structural fires, and a Class B foam concentrate for extinguishing flammable liquid fires. In the illustrated embodiment, the Class A foam concentrate is stored in a first foam tank 40 and pumped by a first foam pump 42 into a first foam manifold 44 that accommodates a first set of foam conduits 46*a, b* . . . n leading to the mixing manifolds 34*a, b* . . . n. A first foam valve 47 is provided in each conduit 46*a, b* . . . n for controlling the amount of class A foam dispensed into the associated mixing manifold 34*a, b* . . . n. Similarly, the Class B foam concentrate is stored in a second foam tank 48 and pumped by a second foam pump 50 into a second foam manifold 52 that accommodates a second set of foam conduits 54*a, b* . . . n leading to the mixing manifolds 34*a, b* . . . n. A second foam valve 55 is provided in each conduit 54*a, b* . . . n for controlling the amount of class B foam dispensed into the associated mixing manifold 34*a, b* . . . n.

The system also includes an air compressor 58 driven by a water motor or hydraulic turbine 66 in the discharge line of the main centrifugal pump 14. The compressor 58 receives ambient air through an air cleaner 68, compresses it, and injects the pressurized air into a gas manifold 56, which is coupled to the mixing manifolds 34*a, b* . . . n via gas conduits 62 a, b, n. The flow of this compressed air, which may be used to resuscitate firefighters or others overcome by smoke inhalation, is regulated by an air control valve 70 in an air conduit 85 leading to the gas manifold 56.

In addition, the system includes a pressurized gas tank 60 for delivering an inert or chemical fire-extinguishing gas to the gas manifold 56. A gas flow valve 63 is provided for regulating the flow between the gas tank 60 and the gas manifold 56. Each mixing manifold 34*a, b* . . . n preferably contains a set of mixing plates (not shown), including a first mixing plate positioned downstream of the conduits, 46*a, b* . . . n, and 54*a, b* . . . n leading from the foam tanks 40, 48, and a second mixing plate positioned downstream of the gas conduits 62*a, b* . . . n. The purpose of these plates is to induce turbulence in the water flowing through the manifolds 34*a, b* . . . n, thus allowing more efficient mixing than would be possible with purely laminar flow.

The control system 10 of the present system comprises a system of valves for regulating flow though the various supply and discharge lines so that the pressure of the fluid or fluids discharged from the nozzle 38 remains safe at all times, regardless of fluctuations in intake pressure, engine rpm, and various other factors. On the intake side of the pump 14, the system includes a first control valve A located between the intake manifold 21 and the tank inlet opening 24, a second control valve B located between the intake manifold and the fire hydrant 22, and a third control valve C located between the tank outlet opening 27 and the supply line inlet opening 28. On the discharge side of the pump 14, the system includes a pressure relief valve D located in the discharge line 30 of the pump 14, and a discharge valve E associated with the nozzle 42, as well as the foam and gas control valves 47, 55, and 63 mentioned earlier.

The control system 10 also provides continuous monitoring of parameters such as flow and pressure at various points throughout the system. Specifically, flow monitoring is achieved by a liquid flow meter 72 located in the fire hose 36. Pressure is monitored by transducers 74, 76, 78, 79, 80, 82, and 84 on or in the intake manifold 21, discharge line 30, hose 32, compressor outlet line 85, gas tank 60, and foam lines 86 and 87, respectively. The level of liquid in the water tank 18 and foam in foam tanks 40 and 48 is monitored by level sensors 88, 90, and 92, respectively. Also included, although not illustrated, are various sensors and/or meters for monitoring conditions such as engine speed, voltage, current, temperature, and so forth.

Figure 2:
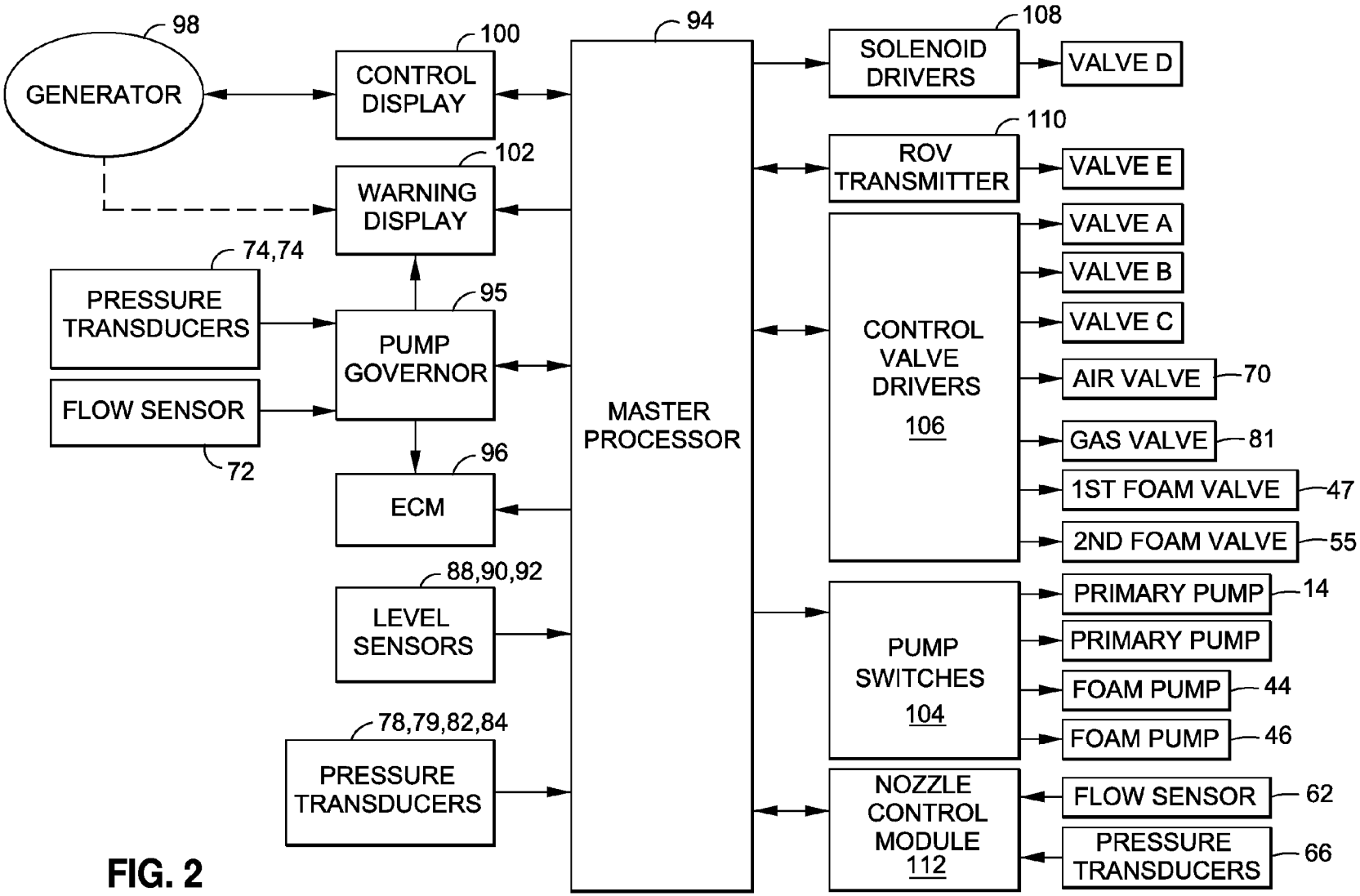
FIG. 2 is a control block diagram of the system.
Figure 3A:
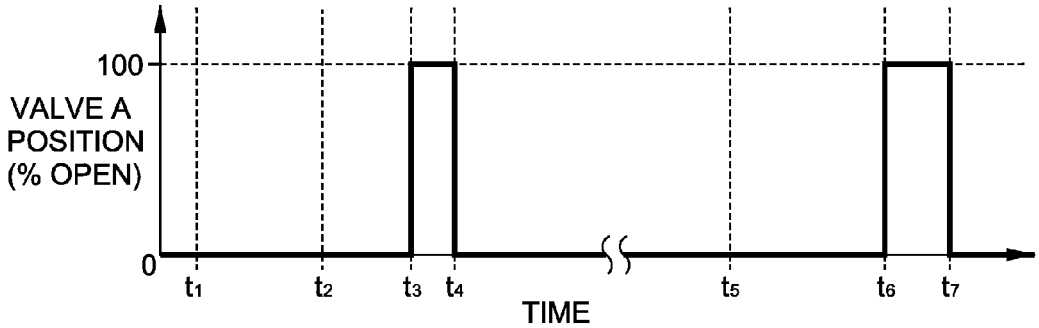
FIGS. 3*a-i* are graphs showing the operation of various elements of the system over time.
Figure 3B:
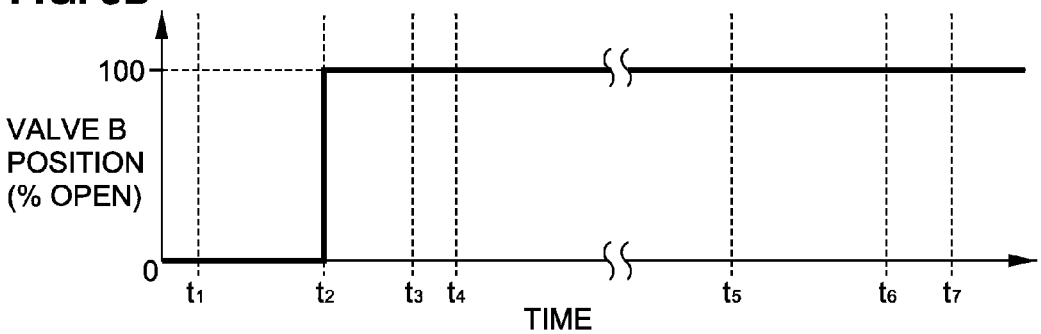
Figure 3C:
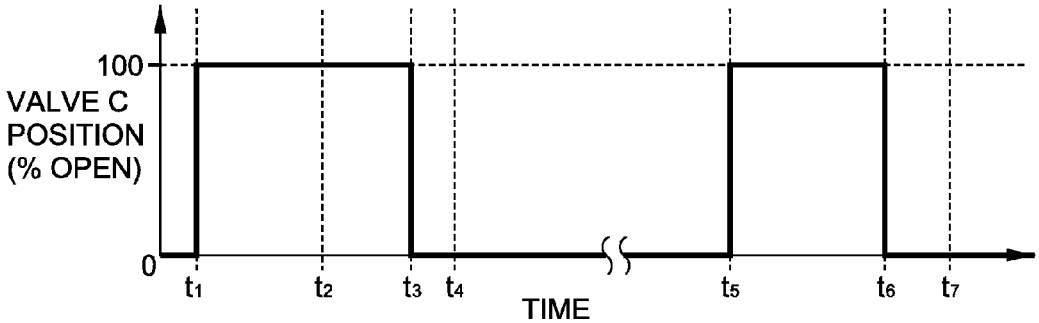
Figure 3D:
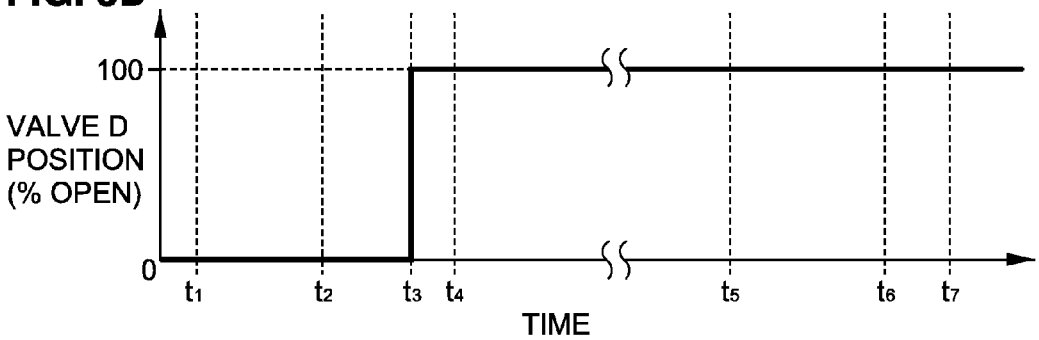
Figure 3E:
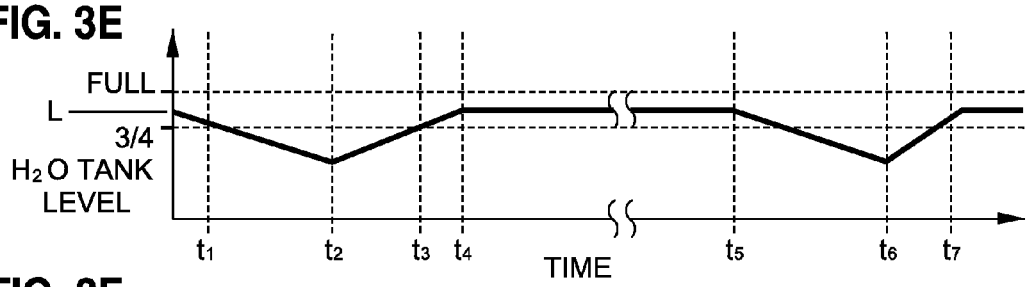
Figure 3F:
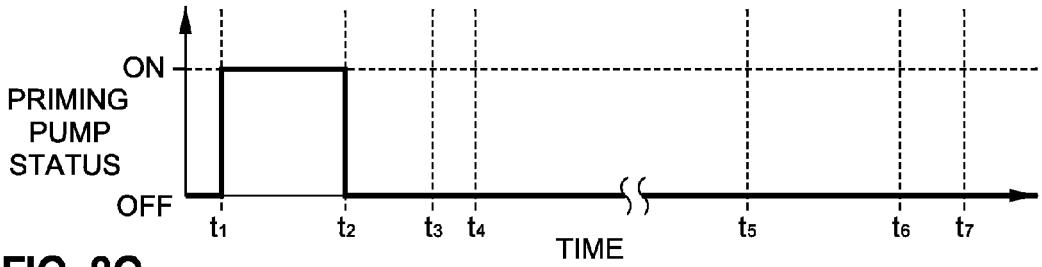
Figure 3G:
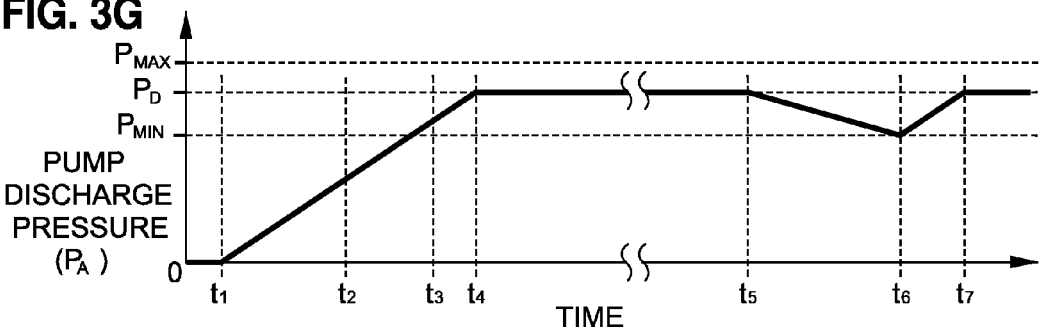
Figure 3H:
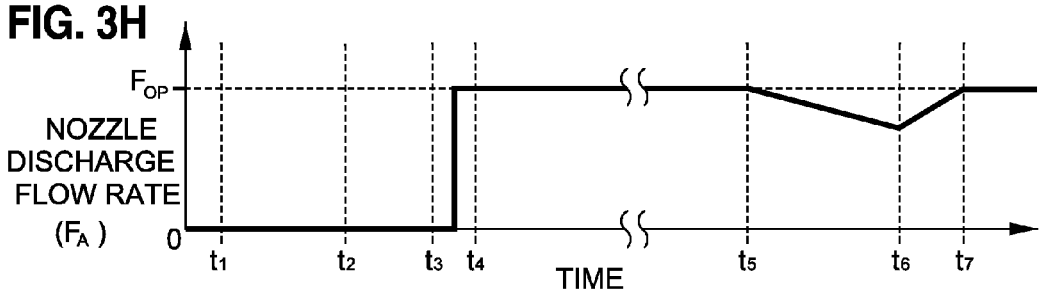
Figure 3I:
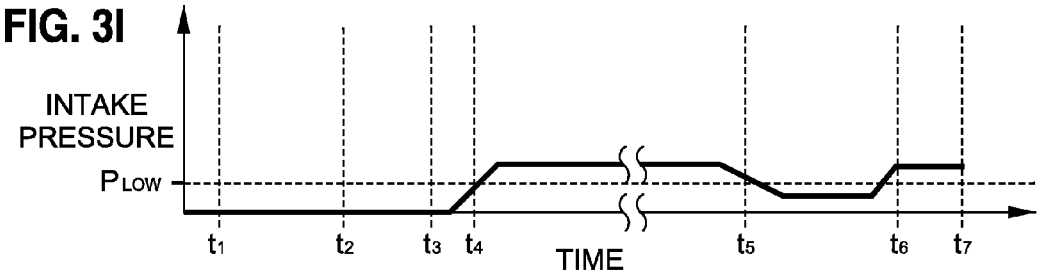

Signals from the monitoring devices 72, 74, 76, 78, 80, 82, 84, 88, 90, 92, and others are input to a master processor 94, which in turn outputs to the pump governor 96, engine control module 96, generator 98, foam pump motors 99, 101, control and warning displays 100, 102, pump switches 104, and drivers 106, 108 for the various valves as shown in FIG. 2. In addition, the master processor 94 sends and receives signals from one or both of a transmitter 110 that allows the discharge valve E to be operated remotely and a nozzle control module 112 that allows manual control by a firefighter carrying the hose. It also monitors voltage and current outputs from the generator 98 (which may be powered either by its own separate engine, not shown, or by power takeoff from the main engine 12), and sends information about these outputs to the vehicle warning and/or display systems 100, 102.

The master processor 94 also includes a recording system (not shown) for recording all the operations of the vehicle and its systems. The system may be queried after an incident for details about the operating times and functions of various components.

Sequential operation of various valves and other components of the system will now be described with continued reference to FIGS. 1 and 2, as well as additional reference to FIGS. 3*a-i*. Initially, all the valves in the system are closed, the water level in the tank 18 is at a preset level L between full and ¾ths full, and the primary pump 14 is off. At time $t_1$, the primary pump 14 is switched on, the tank outlet valve C is opened, and the pump discharge pressure transducer 76 begins to monitor the discharge pressure of the pump. If the transducer 76 detects that the actual discharge pressure $P_A$ is below a preset minimum value $P_{MIN}$, a small electric motor 114 driving a secondary (priming) pump 116 is switched on, and remains in operation until time $t_2$, when $P_{MIN}$ is reached. At this point, the priming pump 116 switches off. Valve C stays open, and valves A and B stay closed until $t_3$, when the pump discharge pressure transducer 76 detects that a preset desired output pressure $P_D$ (typically somewhere between 100 and 150 psi) has been reached, signifying that the nozzle discharge valve E can be opened, and the firefighters may begin spraying at the fire. In addition, the rate of flow $F_A$ is monitored by the flow meter 72, and maintained at an optimum flow rate $F_{OP}$.

If there is no fire hydrant or pressurized water source available at this point, the system continues to operate in this fashion until the water tank 18 is empty. However, if a pressurized source 20 is available, valves A and B are opened and valve C is closed as soon as $P_A=P_D$, allowing water from the pressurized source 20 to flow into the water tank 18. At $t_4$, when the level sensor 86 associated with the water tank 18 detects that the water level has returned to its initial value L, valve A closes so that all the water from the pressurized source 20 flows directly into the pump 14.

After $t_4$, the system is maintained more or less at steady state by the pressure governor 96, which reacts to changes in the discharge pressure $P_A$ by actuating the pressure relief valve D and varying the RPM of the engine 12. Operation of the governor 96 is described in greater detail in U.S. Pat. Nos. 3,786,869 and 4,189,005 to McLoughlin, as well as U.S. Pat. No. 5,888,052 to McLoughlin et al., the contents of all of which are incorporated by reference herein.

In most situations, the operation of the governor 96 is sufficient to keep the system running safely and smoothly, and to maintain the discharge pressure and flow rates within their desired ranges. One exception, however, is when the intake pressure suddenly drops to a very low level, such as when the fire hydrant runs out of water, or when the hose between the hydrant and the pump is run over or develops a leak, or is damaged in some other way. This can cause cavitation of the pump, and may endanger the firefighters on the hose lines. Accordingly, the system includes an intake pressure control mode that is activated whenever the pressure sensed by the intake pressure transducer 74 falls below a preset level $P_{LOW}$ (typically somewhere between 2 psi and 7 psi), as shown at $t_5$ in FIG. 3*i*. When this occurs, the tank discharge valve C reopens, thus increasing the intake pressure by an amount proportional to the level of water in the tank. If, when the discharge valve C closes again at $t_6$, the level of water in the water tank L is below the preset level L, then the hydrant-to-tank valve A opens as shown at $t_6$ in FIG. 3*a*, and remains open until the desired water level L is reached, as shown at $t_7$ in FIG. 3*e*.

The graphs shown in FIGS. 3*a-e* have been greatly simplified for purposes of illustration. For instance, Valves A, B, C, and E, have all been shown to have only two states—fully open and fully closed. In reality, more complex valves having partially open and closed positions could also be used, in which case the changes in system pressure and flow would be more gradual than those shown here, but the basic principles of the invention would remain the same.

Various modifications and variations to the embodiments herein chosen for purposes of illustration will readily occur to those skilled in the art. To the extent that such modifications and variations do not depart from the spirit of the invention, they are intended to be included within the scope of thereof, which is assessed only be a fair interpretation of the following claims.

Having fully described and disclosed the instant invention and alternately preferred embodiments thereof in such clear and concise terms as to enable those skilled in the art to understand and practice the same, the invention claimed is:

1. A Mobile pump system comprising:

an engine;

a reserve tank having an inlet opening, an outlet opening, and a level sensor;

a primary pump driven by said engine, the primary pump including a supply side and a discharge side;

an intake manifold having two inlets and two outlets;

a first conduit for joining one of the inlets of the intake manifold in fluid communication with a source of pressurized liquid, a second conduit for joining one of the outlets of the intake manifold to the inlet opening of the reserve tank;

a third conduit for joining the other inlet of the intake manifold to the outlet opening of the reserve tank;

a supply line for joining the other outlet of the intake manifold to the supply side of the pump;

a first control valve associated with the first conduit, the first control valve having a closed position preventing flow from the source of the pressurized liquid into the intake manifold and an open position allowing flow into the intake manifold;

a second control valve associated with the second conduit, the second control valve having a closed position preventing flow from the intake manifold into the reserve tank and an open position allowing flow from the intake manifold into the reserve tank;

a third control valve associated with the third conduit, the third control valve having a closed position preventing flow from the reserve tank into the intake manifold and an open position allowing flow from the reserve tank into the intake manifold;

an inlet pressure sensor communicating with the intake manifold and monitoring the pressure $P_{IN}$ of liquid in the intake manifold;

a priming pump associated with the primary pump;

a discharge manifold having an inlet opening coupled to the discharge side of the primary pump and a plurality of outlet openings coupled to discharge hoses;

a fourth control valve located between the primary pump and the discharge manifold, the fourth control valve having a closed position preventing flow from the primary pump into the discharge manifold and an open position allowing flow from the primary pump into the discharge manifold;

a fifth control valve disposed between the discharge manifold and a discharge outlet;

a flow meter disposed in a conduit leading to the discharge outlet;

a discharge pressure sensor communicating with the discharge manifold and monitoring the pressure $P_A$ of liquid within the discharge manifold;

a master processor receiving input from the level sensor, the intake pressure sensor, and the discharge pressure sensor, and being programmed to:

actuate the priming pump in response to $P_A$ being below a preset minimum $P_{MIN}$, switch off the priming pump in response to $P_{MIN}$ being at least equal to the preset minimum $P_{MIN}$;

open the first and second control valves in response to the $P_A$ being at least equal to a desired output pressure $P_D$ and the tank level being below a desired level;

shut the second control valve in response to the tank level reaching a desired level;

open the fifth control valve in response to the $P_A$ being at least equal to a desired output pressure $P_D$;

open the third control valve in response to the pressure in the intake manifold $P_{IN}$ being below a preset level $P_{LOW}$;

monitor and maintain the discharge pressure $P_A$ close or equal to the desired output pressure $P_D$; and monitor the flow meter reading to maintain an optimum flow rate to the discharge outlet.

2. The Mobile pump system according to claim 1, wherein said preset low value $P_{LOW}$ is in the range of 2 psi to 7 psi.

* * * * *